US006746339B1

(12) United States Patent
Thibaudeau

(10) Patent No.: US 6,746,339 B1
(45) Date of Patent: Jun. 8, 2004

(54) PUTTING PRACTICE DEVICE AND PRACTICE METHOD USING SAID DEVICE

(75) Inventor: Pierre Thibaudeau, Trois-Rivières (CA)

(73) Assignee: Gestion Thima Inc., Trois-Rivieres (CA)

( * ) Notice: Subject to any disclaimer, the term of this patent is extended or adjusted under 35 U.S.C. 154(b) by 0 days.

(21) Appl. No.: 10/334,666

(22) Filed: Dec. 30, 2002

(51) Int. Cl.[7] ..... A63B 69/36
(52) U.S. Cl. ..... 473/268; 473/267
(58) Field of Search ..... 473/266, 267, 473/268, 258, 260, 273

(56) References Cited

U.S. PATENT DOCUMENTS

| | | | | |
|---|---|---|---|---|
| 1,677,261 | A | | 7/1928 | Williams |
| 2,866,645 | A | | 12/1958 | Cayot |
| 3,273,891 | A | | 9/1966 | Grim, Jr. |
| 3,411,789 | A | | 11/1968 | Wariner |
| 3,572,720 | A | | 3/1971 | Berg |
| 3,656,752 | A | | 4/1972 | Moriarty |
| 3,806,133 | A | | 4/1974 | Cork |
| 3,857,570 | A | | 12/1974 | Gutierrez et al. |
| 4,082,287 | A | * | 4/1978 | Berkey ..... 473/261 |
| 4,129,301 | A | | 12/1978 | Kenney |
| 4,153,255 | A | | 5/1979 | Woodson |
| 4,334,684 | A | | 6/1982 | Sterling |
| 4,437,669 | A | | 3/1984 | Pelz |
| 4,634,131 | A | | 1/1987 | Vella et al. |
| 4,765,625 | A | | 8/1988 | Miner |
| 4,927,153 | A | | 5/1990 | Schaefer |
| 5,007,646 | A | | 4/1991 | Baber et al. |
| 5,011,153 | A | | 4/1991 | Watkins |
| 5,072,943 | A | | 12/1991 | Sindelar |
| 5,074,565 | A | | 12/1991 | Tucker |

(List continued on next page.)

FOREIGN PATENT DOCUMENTS

| | | |
|---|---|---|
| JP | 4361762 | 12/1992 |
| JP | 7275426 | 10/1995 |
| JP | 01-029528 | 2/2001 |
| WO | 83/03770 | 11/1983 |
| WO | 00/13754 | 3/2000 |
| WO | 02/05905 | 1/2002 |

OTHER PUBLICATIONS

Green Genius, endorsed by Nick Price, http://www.shotsavers.com/products/greengenius.htm Mar. 12, 2002.
Sindelar on Trace System, http://www.shotsavers.com/products/sindelar.htm Mar. 12, 2002.
High Tech Track, http://www.shotsavers.com/products/hightechtrack.htm Mar. 12, 2002.
Pelz Truthboard, http://www.shotsavers.com/products/truthboard.htm Mar. 12, 2002.
Pelz Putting Track, http://www.shotsavers.com/products/pelputtingtrack.htm Mar. 12, 2002.
Putting Track, http://www.shotsavers.com/products/golfsmithputtingtrack.htm Mar. 12, 2002.
Right on Line, http://www.shotsavers.com/products/rightoline.htm Mar. 12, 2002.

*Primary Examiner*—Raleigh Chu
(74) *Attorney, Agent, or Firm*—Darby & Darby

(57) ABSTRACT

A putting practice device includes first and second members and maintaining, indicating and positioning portions. The first member includes a sliding surface against which a putter blade is slidable according to a vertical pendulum movement. The maintaining portion maintains the sliding surface on a rolling surface for a golf ball, and maintains the sliding surface perpendicular to the rolling surface and parallel to a putting line for the golf ball toward a target. The second member including includes a portion defining a sight including a reflecting surface surrounding the said sight, the reflecting surface being provided on a top portion of the second member. The indicating portion allows indicating the a center of said sight. The positioning portion is for positioning the sight above the putting line and the golf ball.

12 Claims, 7 Drawing Sheets

U.S. PATENT DOCUMENTS 5,131,659 A 7/1992 Lindberg, Jr.
5,150,904 A 9/1992 Sindelar
5,152,534 A 10/1992 Sindelar
5,246,233 A 9/1993 Sheltman et al.
5,294,124 A 3/1994 Florian
5,362,057 A 11/1994 Arima
5,393,065 A 2/1995 Lequyea
5,435,547 A 7/1995 Lee
5,437,458 A 8/1995 Apringer
5,443,264 A 8/1995 Mehrens
5,503,395 A 4/1996 Cook
5,527,041 A 6/1996 Terry, III et al.
5,586,945 A 12/1996 Vonderhaar
5,709,612 A 1/1998 Salado
5,776,007 A 7/1998 Kendall et al.
5,797,804 A * 8/1998 Chen ..... 473/260
6,019,685 A 2/2000 Fonseca et al.
6,159,106 A * 12/2000 Adams ..... 473/265
6,416,420 B1 * 7/2002 Stark ..... 473/257

* cited by examiner

PUTTING PRACTICE DEVICE AND PRACTICE METHOD USING SAID DEVICE

FIELD OF THE INVENTION

The invention relates to a putting practice device. The invention also relates to a putting practice method using said device.

DESCRIPTION OF THE PRIOR ART

Numerous kinds of devices are known in the art to practice putting. Said devices are mainly divided in three groups.

Group I Putting practice devices essentially provided with a sight and allowing a golfer to place his head vertically above the ball while putting. See U.S. Pat. Nos. 1,677,261, 5,131,659, 5,294,124 and 5,443,264, and Japanese patent application no. 20001019528.

Group II Putting practice devices essentially provided with a ramp and allowing to guide the putter head along a desired putting line for a golf ball. See U.S. Pat. Nos. 2,866,645, 3,411,789, 3,806,133, 3,857,570, 4,129,301, 4,153,255, 4,437,669, 4,634,131, 4,765,625, 5,072,943, 5,150,904, 5,152,534, 5,246,233, 5,362,057, 5,393,065, 5,437,458, 5,586,945, 5,776,007 and 6,019,685.

Group III Putting practice devices provided at once with a sight and a ramp and allowing a golfer to place his head vertically above the ball while putting and to execute an appropriate pendulum movement with his putter and hit the ball while following the ramp. See U.S. Pat. Nos. 3,656,752, 4,927,153, 5,007,646 and 5,503,395. More particularly, in this last group, there is also a putting practice device further provided with a sight mounted on a tower. See U.S. Pat. No. 3,656,752.

None of the aforesaid documents discloses a device that allows a user (e.g. a golfer) to take a correct stance with respect to the ball and desired putting line for said ball, and simultaneously that allows to visually check whether or not said stance has been lost while executing a vertical pendulum movement to hit said ball along said putting line.

The applicant has now discovered a new putting practice device that allows to overcome drawbacks of the prior art devices. The applicant has also discovered a new method to practice putting that is simple and allows self-correction of errors in the stance and/or in the putting movement (putting stroke).

SUMMARY OF THE INVENTION

The present invention relates to a putting practice device comprising in combination:

a) a first member provided with a planar sliding surface against which the toe of a putter blade is slidable according to a vertical pendulum movement;

b) first means for maintaining said planar sliding surface on a ground defining a rolling surface for a golf ball, and maintaining said planar sliding surface substantially perpendicular to said rolling surface and substantially parallel to a putting line for said golf ball toward a target;

c) a second member comprising a portion defining a sight, said portion comprising at least one planar reflecting surface surrounding the sight, said planar reflecting surface being provided on top of a portion of said second member;

d) means allowing to substantially indicate the center of the sight; and e) second means for positioning said sight above the putting line and the golf ball;

the eyes of a user being systematically positioned substantially perpendicular to the golf ball when said user has the toes of his feet substantially parallel to the sliding surface and substantially equidistant to the center of the sight, has the toe of the putter blade against said sliding surface, sees the golf ball through said sight and sees his face but not his eyes in the planar reflecting surface.

According to a preferred embodiment of the invention, means allowing to substantially indicate the center of the sight may comprise at least one sight mark, more preferably a sight mark substantially at mid-width of said sight.

According to a particularly preferred embodiment, the invention relates to a device that allows the development of an almost perfect putting stroke.

According to another particularly preferred embodiment, the invention relates to a device that favors an active and permanent learning of an almost perfect putting stroke.

According to another particularly preferred embodiment, the invention relates to a device that favors the appropriate learning, the improvement and/or the correction of all golfers putting stroke.

According to another particularly preferred embodiment, the invention is intended to be used by experienced golfers or beginners.

According to another particularly preferred embodiment, the invention relates to a device that is pleasant and easy to use, and allows to quickly identify what is wrong with the user stance or putting movement and allows said user to correct it as quickly.

According to another particularly preferred embodiment, the invention relates to a device that can be adjusted to various kinds of putters.

According to another particularly preferred embodiment, the invention relates to a device that has visual marks allowing to practice the amplitude of the vertical pendulum movement and thereby the force of the stroke and velocity of the ball.

Advantageously, the first member may comprise a unitary member or several sub-members interconnected together by any appropriate means. Preferably, said first member may have opposite ends and a planar sliding surface. More preferably, said first member is a unitary member such as a plate.

Advantageously, first means may further comprise a support member having opposite ends, one end being connected to the first member, behind the sliding surface, the opposite end contacting the ground.

Advantageously, the second member may comprise a unitary member or several sub-members interconnected together by any appropriate means. More preferably, said second member comprise sub-members. One of said sub-member may be provided with the sight, another of said sub-member may be connected to the first member or first means.

Advantageously, second means comprises an extensible portion of the second member allowing to move the sight substantially perpendicular to the sliding surface and position it above the putting line. Preferably, said extensible portion is a telescopic portion. More preferably, said telescopic portion is of drawer type.

Advantageously, said sight may consist of a window provided in said second member. Preferably, said window is a rectangular window which may be more preferably divided into a odd number of smaller windows by an even number of strips, marks or members. Preferably, said strips, marks or members are substantially perpendicular to the sliding surface. Preferably, the sight mark may be aligned at the mid-width of a median smaller window. More preferably, said sight mark is substantially perpendicular to the sliding surface.

Advantageously, a top portion of the first member may be further provided with a set of distinctive marks providing information about the amplitude of the vertical pendulum movement of the putter blade.

The invention also relates to a method for practicing putting with a device as defined hereinbefore in accordance with the invention. This method comprises at least the following steps:

a) positioning a golf ball in the putting line and eventually positioning the sight above the ball and the putting line;

b) when a user is in a putting stance, placing the toe of the putter blade against the sliding surface of the first member;

c) positioning the toes of the feet of the user substantially parallel to the sliding surface of the first member and substantially equidistant from the center of the sight (preferably from the sight mark);

d) positioning the eyes of the user above the sight so as said user sees the ball through said sight and sees his face in the planar reflecting surface but not his eyes; and e) according to a vertical pendulum movement, moving the putter blade backwardly and then forwardly to hit the golf ball while keeping the toe of the putter blade against the sliding surface and maintaining his eyes above the sight so as to see his face in the reflecting surface but not his eyes.

BRIEF DESCRIPTION OF THE DRAWINGS

Particularly preferred embodiments of the invention will be described hereinafter with reference to the following drawings.

DETAILED DESCRIPTION OF PARTICULARLY PREFERRED EMBODIMENTS

Figure 1:
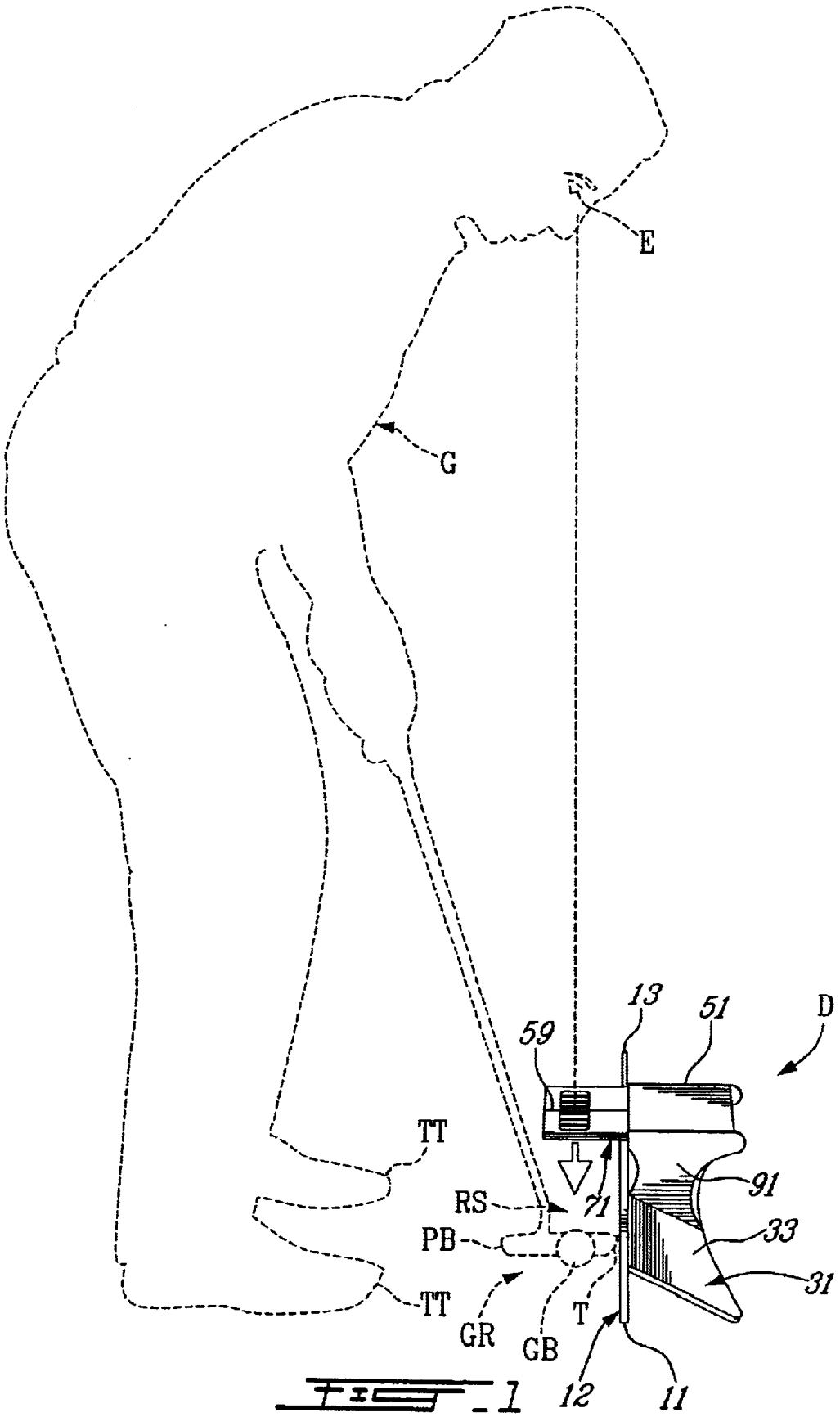
FIG. 1 is a perspective view of a particularly preferred embodiment of a device according to the invention when used by a left-handed golfer (an arrow indicates that the front eye of the golfer is substantially at the vertical of the ball)
Figure 2:
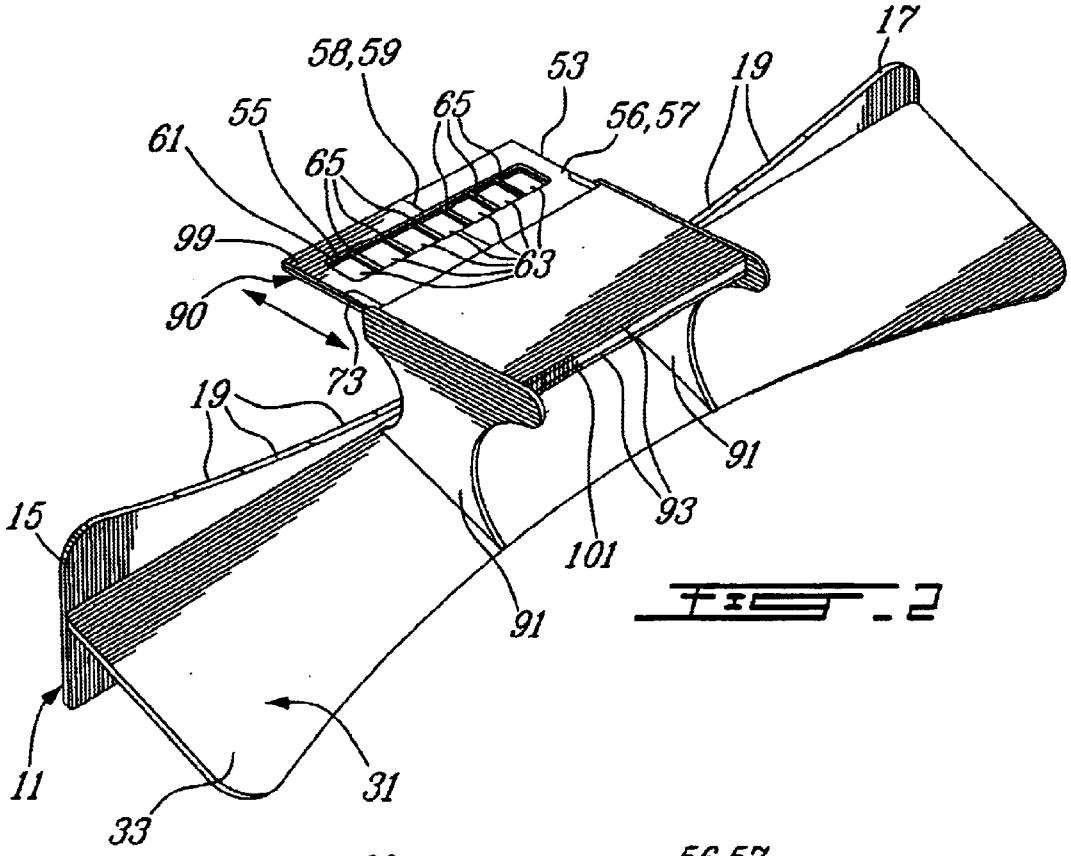
FIG. 2 is a rear perspective view of the device of FIG. 1.
Figure 2A:
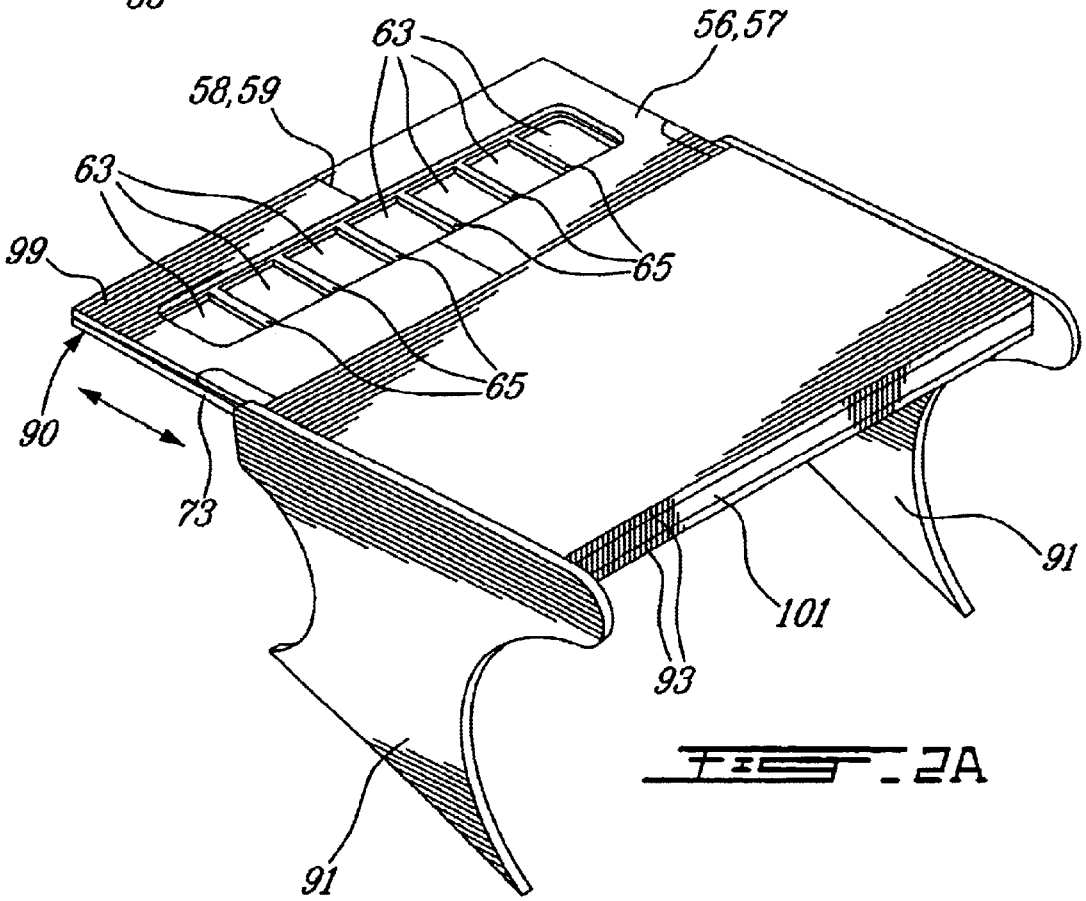
FIG. 2*a* is a partial perspective view of the device of FIG. 1.
Figure 3:
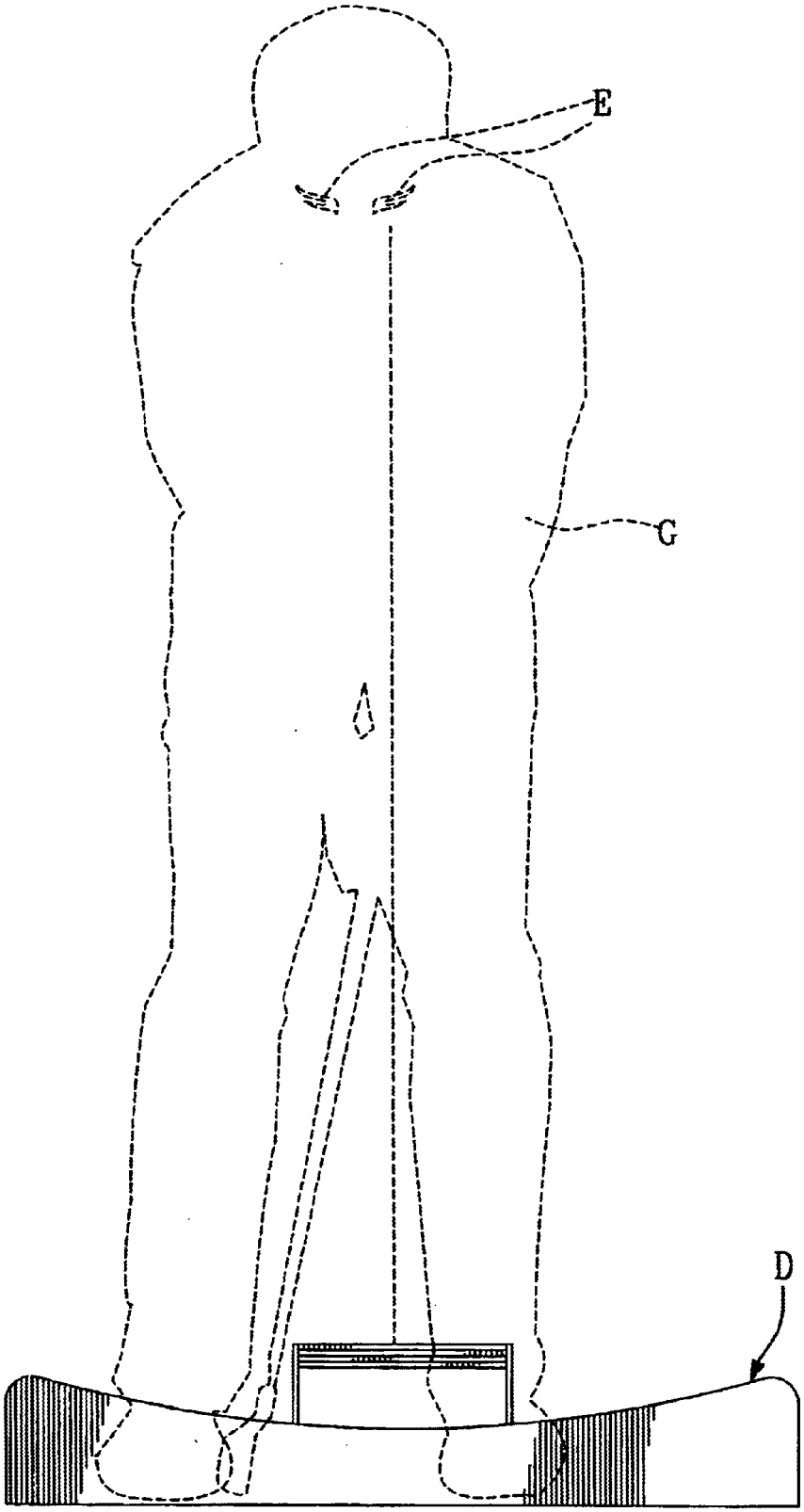
FIG. 3 is a face view of the device of FIG. 1 when used by a right-handed golfer (an arrow indicates that the front eye of the golfer is substantially at the vertical of the ball)
Figure 3A:
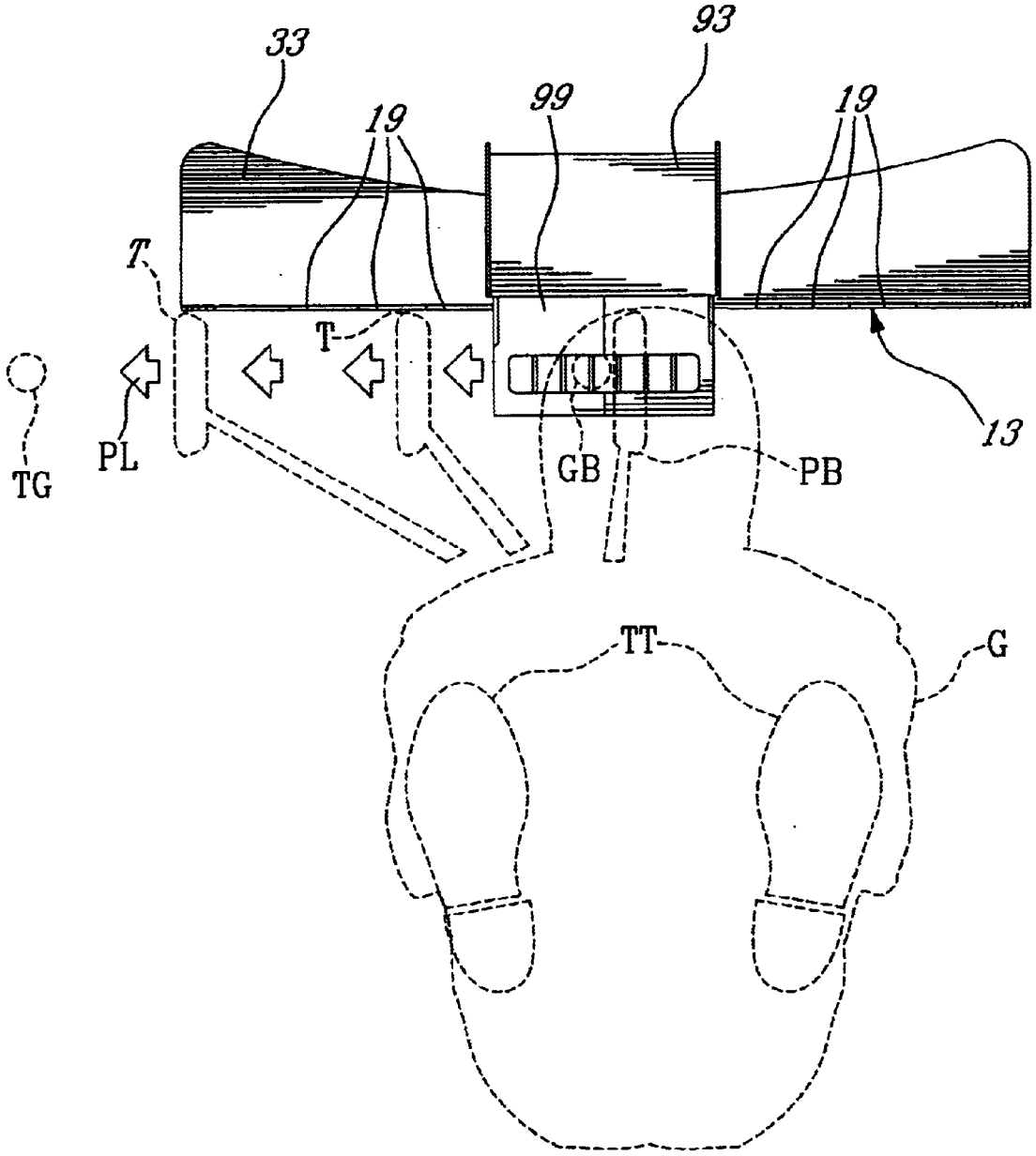
FIG. 3*a* is a top view of the device of FIG. 3 when used by a right-handed golfer.

As illustrated in the drawings, a preferred embodiment of the invention relates to a putting practice device "D" for a golfer "G". This device "D" is put on the ground "GR" and comprises in combination a first member 11, first means 31, a second member 51 and second means 71. Said ground "GR" may be, for example, a golf green (preferably for outdoor practice) or a floor surface (preferably for indoor practice).

The first member 11 may be provided with a planar sliding surface 13 against which the toe "T" of a putter blade "PB" is slidable according to a vertical pendulum movement. This first member 11 defines a ramp 12 that may be used as a reference for the alignment and allows the user to develop a vertical pendular movement by maintaining the stroke of the putter and the face of the putter always in line with the target (i.e. in line with the putting line).

Figure 4:
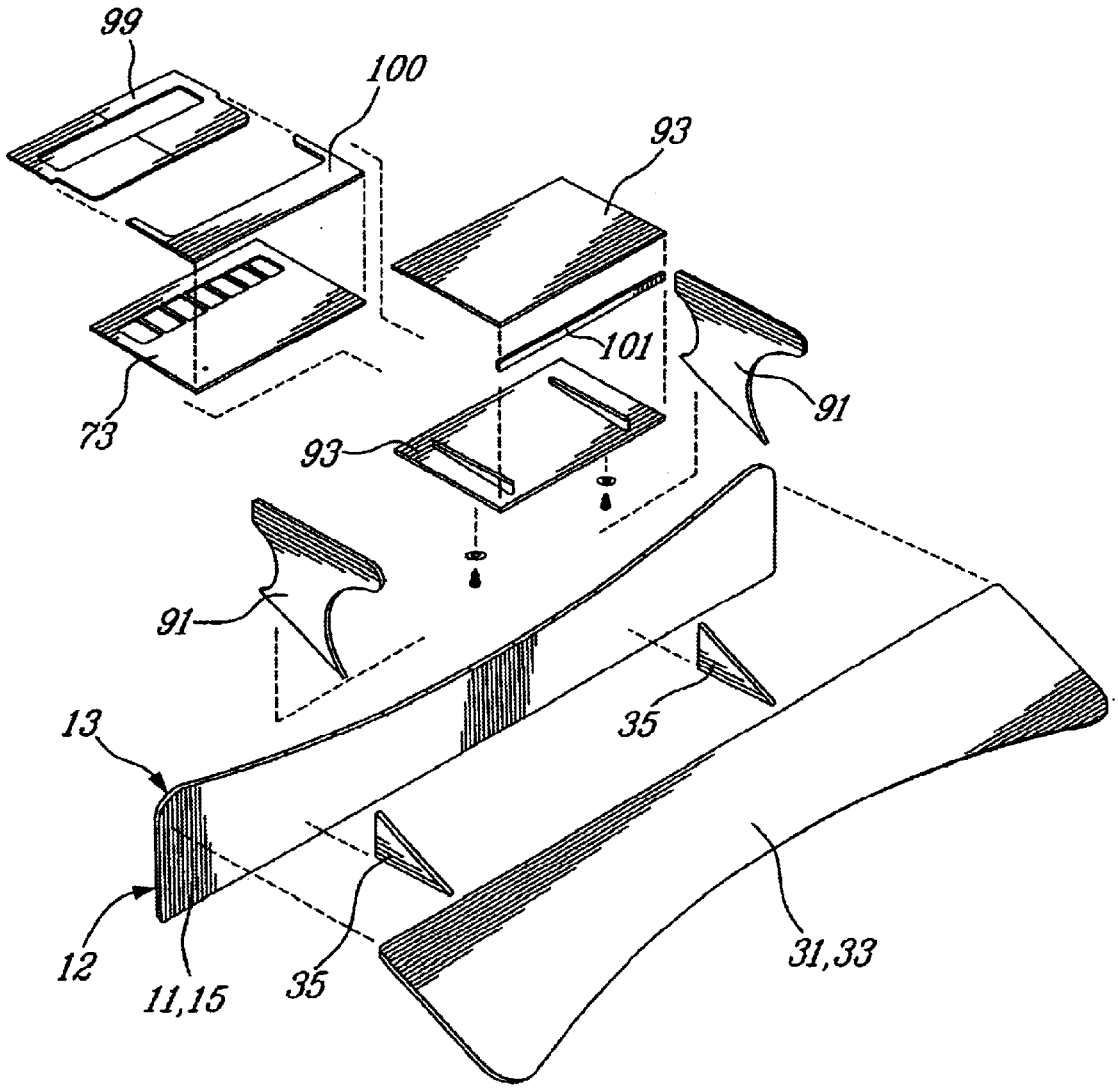
FIG. 4 is an exploded view of the device of FIG. 1.
Figure 5:
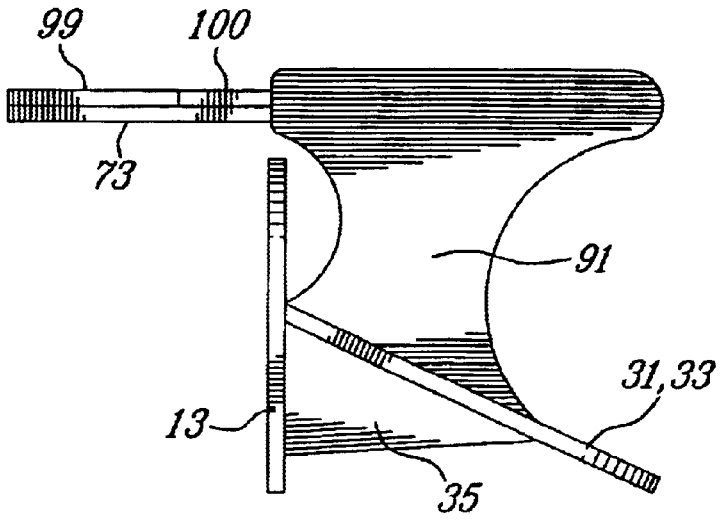
FIG. 5 is a side elevational view of the device of FIG. 1.
Figure 6:
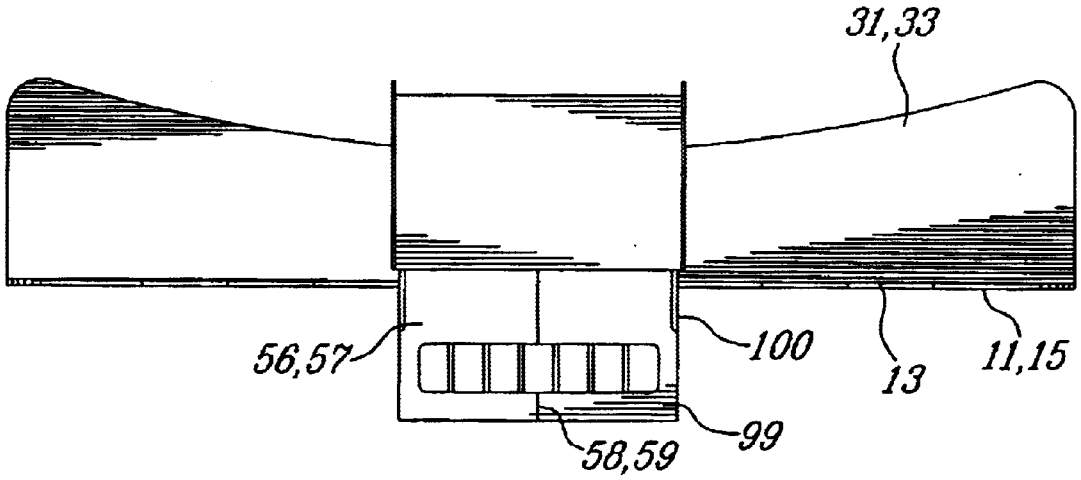
FIG. 6 is a top plane view of the device of FIG. 1.
Figure 7:
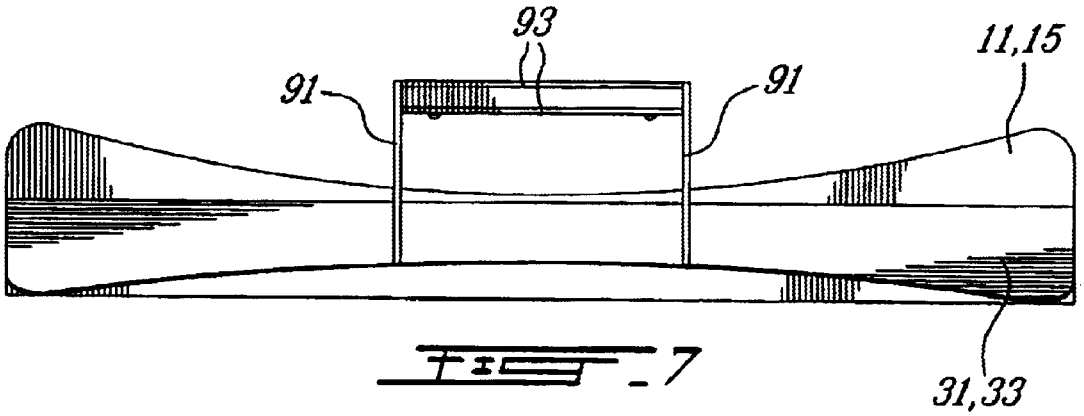
FIG. 7 is a rear elevational view of the device of FIG. 1.
Figure 9:
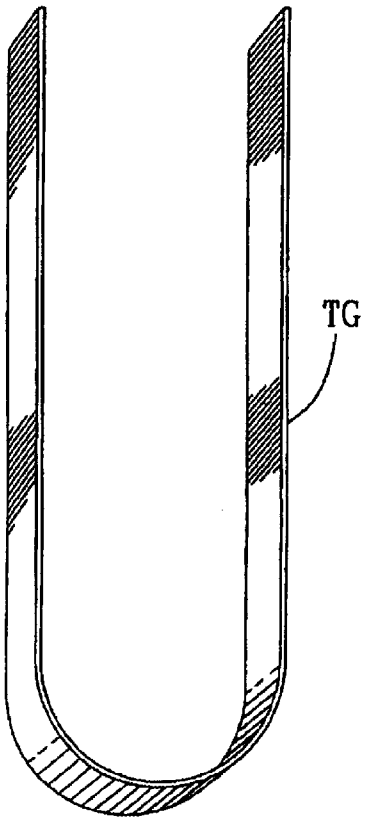
FIG. 9 is a view of another optional accessory usable with the device of FIG. 1.
Figure 8:
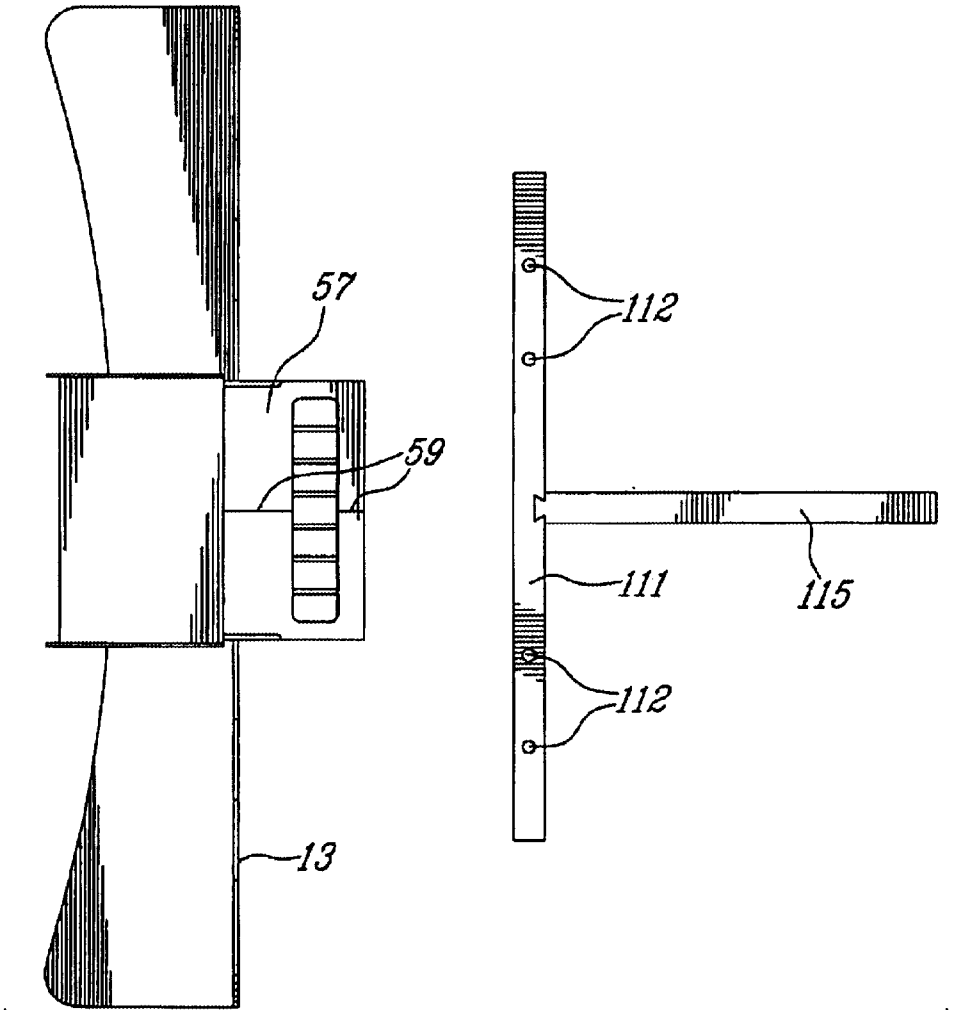
FIG. 8 is a view of an optional accessory usable with the device of FIG. 1.

With reference to the particularly preferred embodiment shown in FIG. 4, the first member 11 defines a ramp 12 where a plate 15 has one face thereof defining said planar sliding surface 13. Advantageously, the base of this plate 15 rests directly on the ground "GR". However, said plate 15 may be optionally provided with supports or legs (not illustrated) that rests on said ground.

For example, the plate 15 advantageously have an arc shape and may be made of any appropriate material (e.g. plastic material such as acrylic material) and may have a thickness of about 0.25 inch, a length of 30 inches, an arc shape and a height about 5 inches (at its ends) and 3 inches in the middle.

First means 31 allows to maintain the surface 13 on the ground "GR" which is defining a rolling surface "RS" for a golf ball "GB", and allows to maintain said surface 13 substantially perpendicular to said rolling surface "RS" and substantially parallel to a putting line "PL" for said golf ball "GB" toward a target "TG".

According to a particularly preferred embodiment illustrated in the drawings, especially in FIG. 4, the first means 31 may be a support member 33 that also has an arc shape. This support member 33 has opposite ends, one end being connected to the plate 15, behind the surface 13, the other end contacting the ground or floor. Preferably, the support member 33 is connected to the plate 15 by any appropriate means, such as gluing. Optionally, angle members 35 may be provided to improve the solidity of the resulting structure. These angle members 35 are preferably connected to the plate 15 and the support member 33 by any appropriate means, such as gluing. The support member 33 and angle members 35 are preferably made with the same material than the plate 15.

The second member 51 may comprise a portion 53 defining a sight 55, and may comprise at least one planar reflecting surface 56, especially a mirror 57, surrounding the sight 55. The mirror 57 may be provided on top of a portion of said second member 51. Preferably, a sight mark 58 is aligned with the sight 55. This sight mark is preferably a line 59 perpendicular to the surface 13 and provided on the mirror 57.

Second means 71 are for positioning and eventually moving said sight 55 above the putting line "PL" and the golf ball "GB". Preferably, the line 59 is substantially perpendicular to the sliding surface 13.

The eyes "E" of a golfer "G" are systematically positioned substantially perpendicular to the golf ball "GB" when said golfer "G" has the toes "TT" of his feet "F" substantially parallel to the sliding surface 13 and substantially equidistant to the line 59, has the toe "T" of its putter blade "PB" against said sliding surface 13, sees the golf ball "GB" through said sight 55 and sees his face but not his eyes "E" in the mirror 57.

Preferably, second means 71 comprise an extensible portion 73 of the second member 51. This extensible portion 73 is advantageously telescopic and, as illustrated, may be of drawer type. This extensible portion 73 allows to move the sight 55 substantially perpendicular to the sliding surface 13 and position it above the putting line "PL".

Preferably, the sight 55 may consist of a rectangular window 61 that may be divided into a odd number of smaller windows 63 by an even number of strips, marks or members, preferably strips 65. Preferably, these strips 65 allow the user to align the putter blade "PB" with the target and indicate if the face of the putter blade makes a square contact with the golf ball. Preferably, the line 59 may be at the mid-width of a median window 63.

Preferably, a top portion 17 of the first member 11 may be further provided with a set of distinctive marks 19 which may provide information about the amplitude of the vertical pendulum movement of the putter blade "PB". According to a particularly preferred embodiment of the invention, marks 19 may consist of color stripes. Preferably, three pairs of different color stripes may be printed on the upper edge of the plate 15 on both sides of the sight 55. When the user swings, he can execute a short (green), medium (yellow) or long (red) pendular movement.

According to a particularly preferred embodiment, the second member 51 and second means 71 may comprise a tower portion, a telescopic portion, a sight portion and a mirror provided with a sight mark (example a red line). According to a particularly preferred embodiment, the tower portion is located on the center of the ramp 12, hangs over the ramp 12 and holds up a drawer 90 containing a mirror 57 and a sight 55. This drawer 90 defines with a corresponding housing in the tower, part of said second means 71. This assembly allows the use of all kinds of conventional putters, without the risk of having the club shaft hit the mirror 57, once the drawer 90 is opened.

According to a particularly preferred embodiment, the tower consists of two substantially vertical members 91 spaced apart from each other and connected by two substantially horizontal members 93 defining with said members 91 a housing 95 for another substantially horizontal member 97 that is sized to fit within said housing 95 and slide therein from an open position to a closed position. One end of said member 97 is provided with the sight 55 of said second member 51 and its top surface surrounding said sight 55 is covered by another member 99 comprising a mirror 57. The sight 55 comprises openings provided in said members 97 and 99 to define windows 63. Optionally, a frame 100 may be provided for the member 99 defining the mirror 57. The mirror 57 may be a rectangle of 8 inches by 4.5 inches. Furthermore, said mirror 57 may be further provided with a red line defining said line 59.

Preferably, the tower hangs over the center of the ramp 12 and rests on the support member 33. This tower has such a height that it hangs at above 6.5 inches above the ground "GR". Preferably, it may have 8.5 inch width. The space between both substantially horizontal members may be of 0.75 inch thick, 8 inches width and 5.5 inches long, and substantially vertical members 91 are spaced apart at about 8 inches. Preferably, a stop member 101 may be provided behind the housing 95.

According to a particularly preferred embodiment, when the user opens the drawer 90, he sees the mirror 57, the line 59 in the center and windows 63. These elements allow the user to take a good stance and to correctly position himself, with respect to the golf ball "GB", the device "D" and the target.

Members 33, 91, 93 and 101 may be made with the same material than plate 15, and connected by any appropriate means such as gluing. Members 97 and 100 may be made with the same material than plate 15. Optionally, member 99 may be a reflecting material or a material similar to the material of plate 15 coated by a thin layer reflecting material. Members 97, 99 and 100 may be connected by any appropriate means such as gluing.

The invention also relates to a method for practicing putting with a device as defined hereinbefore in accordance with the invention. This method comprises at least the following steps:

a) positioning a golf ball "GB" in the putting line "PL" and eventually positioning the sight 55 above the ball "GB" and the putting line "PL";

b) when a user is in a putting stance, placing the toe "T" of the putter blade "PB" against the sliding surface 13 of the first member 11;

c) positioning the toes "TT" of the feet of the user substantially parallel to the sliding surface 13 of the first member 11 and substantially equidistant from the center of the sight (preferably from the sight mark 58);

d) positioning the eyes "E" of the user above the sight 55 so as said user sees the ball "GB" through said sight 55 and sees his face in the planar reflecting surface 56 but not his eyes; and e) according to a vertical pendulum movement, moving the putter blade "PB" backwardly and then forwardly to hit the golf ball while keeping the toe "T" of the putter blade "PB" against the sliding surface 13 and maintaining his eves above the sight 55 so as to see his face in the reflecting surface 56 but not his eyes.

Preferably, when the ball "GB" is hit and has vanished out of sight 55, the golfer continues to look in the sight 55. The golfer sees the ball "GB" leaving the sight 55.

The flow lines are imaginary lines that go through the key parts of body of the golfer (shoulders, eyes, forearms, hips, knees and feet) when said golfer addresses the ball and during the putting stroke. When the golfer takes his stance, if his toes are parallel to the ramp 12, his putter blade "PB" perpendicular to the ramp 12, his eyes over the ball and invisible in the mirror, then the other flow lines are in the right position.

According to a particularly preferred embodiment of the invention, a golfer may use the device "D" as follows:

A) Calibration of the Device

The user opens the drawer 90 until the upper part of the mirror 57 is approximately the same size as the sight 55. Then the user adjusts his putter by resting the toe of the putter blade "PB" against the ramp 12, under the line 59 in the mirror 57; and he makes sure the center of the putter blade is in the center of the sight 55 by closing or opening the drawer 90 as necessary.

B) Putting Stance

With the help of his putter, the user puts a ball "GB" on the ground "GR", in the center of the sight 55, under the line 59 or slightly in front of it. Then the user places his putter blade behind the ball "GB" to make sure the face of the putter blade is parallel to the strips 65 in the sight 55 and that the toe "T" of the putter blade rests against the sliding surface 13 of the ramp 12. The golfer takes a putting stance by slightly bending his knees and leaning his head forward until his eyes are directly over the ball (he will see all of the ball through the sight 55 and his eyes are completely out of the mirror 57); and he aligns the toes "TT" of his feet parallel to the ramp 12 while seeing his face in the mirror 57 but not his eyes. Preferably the golfer will try to reach a good and comfortable position with his weight positioned on the center of his feet.

C) The Backswing

The golfer slightly leans the front shoulder downward and pulls up the back shoulder keeping them parallel to the putting line "PL" (vertical pendulum). The toe "T" of the putter blade "PB" remains on the ramp 12; eyes "E" are always on the ball "GB" through the sight 55. The wrists, forearms, arms, hands and putter follow the shoulders movement in a passive way, staying parallel to the putting line, and maintain the triangle made with the shoulders. The eyes "E" are always on the ball through the sight 55. The user moves the putter blade "PB" till the desired extension is reached (color strips 19 on the ramp 12).

D) The Downswing

The putter blade "PB" comes back towards the ball, the golfer making sure his shoulders remain in control of the movement. Wrists, forearms, arms, hands, and the putter are still passive. The triangle is maintained. The toe "T" of the putter blade "PB" is still resting on the ramp 12. Eyes "E" never left the ball "GB".

E) The Follow Through

The putter blade "PB" hits the ball. Front shoulder of the golfer goes up, back shoulder goes down, always in the same vertical axis. The golfer sees the ball "GB" leaving the sight 55. The toe "T" of the putter blade "PB" never left the ramp 12.

A regular and satisfying putting stroke must meet some fundamental rules. More particularly, the device and the method according to the invention will allow the user to check whether or not he meets said fundamental rules. Also, the device and method according to the invention will allow the user to master these rules and supply help in identifying and correcting what is wrong. Examples of such rules are the following:

1. The stance of the golfer parallel to the target (hole).
2. The face of the putter blade perpendicular to the putting line "PL" for the full swing.
3. Putting done in a vertical pendulum movement, initiated and controlled by the shoulders of the golfer.
4. Swing extension the same backward and forward.
5. When stroking the ball, the front eye directly over or slightly behind the ball and stay in that position for the entire putting stroke.
6. The golfer keeps his eyes on the ball, and keeps his head still during the putting stroke.
7. The flow lines are parallel to the putting line "PL" when addressing the ball "GB" and until the stroke is completed.
8. During the putting stroke, the lower body must remain still. The flow lines made by the feet, hips and knees of the golfer remain parallel to the putting line and do not move.
9. The only parts of the upper body that will move are the shoulders, the arms, the forearms and the hands while maintaining the flow lines as per their parallel orientation to the putting line "PL".

The device and method according to the invention may be used with optional accessories. Their purpose is to make the use of said device and method easier and more pleasant.

A first accessory may consist of a T-bar. For example, this accessory may be made of two plastic bars that fit into each other to make a T. This T-bar allows the golfer to align his feet parallel to the target and the ramp.

The longest piece 111 (i.d. the one with holes 112) is placed parallel to the ramp 12. The holes have two uses: Outside: to hold the T bar on the practice green with 2 tees. Outside and inside: to allow the golfer to always take the same stance. These holes 112 work as landmarks for the alignment of the feet "F" of the golfer and the space between them.

The shortest piece 115 is perpendicular to the ramp 12 and is put on the ground "GR" in line with the line 59 that goes through the mirror 57, allowing the golfer to take position in the center of the device "D".

Using the T-bar is not mandatory, but it is and excellent basic tool for the proper alignment of the feet of the golfer when taking a putting stance.

A second accessory may consist of a target "TG". Such a target may be a <<U >> shaped member with a width equivalent to the diameter of a golf hole. Preferably, a target may hold about ten golf balls "GB". Target "TG" may be used inside or outside (putting it around a hole on a practice green). Targets "TG" can be put at variable distances to let the golfer practice putts with various extension movements.

Aforesaid accessories are not essential. However, they make easier the use of a device according to the invention and allow a better visualization of the results.

Of course, the above description of the embodiments of the invention is not limitative and also comprises all possible variations and embodiments that may seem obvious to a man skilled in the art.

The embodiments of the invention in which an exclusive right of property or privilege is claimed, are defined as follows:

1. A putting practice device comprising in combination:

a) a first member provided with a planar sliding surface against which the toe of a putter blade is slidable according to a vertical pendulum movement;

b) maintaining means for maintaining said planar sliding surface on a ground defining a rolling surface for a golf ball, and maintaining said planar sliding surface substantially perpendicular to said rolling surface and substantially parallel to a putting line for said golf ball toward a target;

c) a second member comprising a portion defining a sight, said portion comprising at least one planar reflecting surface surrounding the sight, said planar reflecting surface being provided on top portion of said second member;

d) indicating means allowing to indicate the center of sight; and e) positioning means for positioning said sight above the putting line and the golf ball;

the eyes of a user being systematically positioned substantially perpendicular to the golf ball when said user has the toes of his feet substantially parallel to the sliding surface and substantially equidistant to the center of the sight, has the toe of the putter blade against said sliding surface, sees the golf ball through said sight and sees his face but not his eyes in the planar reflecting surface.

2. A putting practice device according to claim 1, wherein said indicating means comprise at least one sight mark.

3. A putting practice device according to claim 2, wherein said positioning means comprise an extensible portion of the second member allowing to move the sight substantially perpendicular to the sliding surface and position it above the putting line.

4. A putting practice device according to claim 3, wherein the extensible portion is a telescopic portion.

5. A putting practice device according to claim 2, wherein said maintaining means comprise a support member having opposite ends, one end being connected to the first member, behind the sliding surface, the opposite end contacting the ground; and wherein said indicating means comprise a telescopic portion of the second member allowing to move the sight substantially perpendicular to the sliding surface and position it above the putting line.

6. A putting practice device according to claim 5, wherein said telescopic structure is of a drawer type.

7. A putting practice device according to claim 5, wherein said sight defines a rectangular window in said second member, and wherein said window is divided into a odd number of smaller windows by an even number of strips, marks or members, and the sight mark is substantially at the mid-width of a median smaller window.

8. A putting practice device according to claim 7, wherein a top portion of the first member is further provided with a set of distinctive marks providing information about the amplitude of the vertical pendulum movement of the putter blade.

9. A putting practice device according to claim 1, wherein said maintaining means further comprises a support member having opposite ends, one end being connected to the first member, behind the sliding surface, the opposite end contacting the ground.

10. A putting practice device according to claim 1, wherein said sight defines a window in said second member.

11. A method for practicing putting with a device as defined in any one of claims 1 to 10, said method comprising the steps of:

a) positioning a golf ball in the putting line;

b) when a user is in a putting stance, placing the toe of the putter blade against the sliding surface of the first member;

c) positioning the toes of the feet of the user substantially parallel to the sliding surface of the first member and substantially equidistant from the center of the sight;

d) positioning the eyes of the user above the sight so as said user sees the ball through said sight and sees his face in the planar reflecting surface but not his eyes; and e) according to a vertical pendulum movement moving the putter blade backwardly and then forwardly, to hit the golf ball while keeping the tip of the putter against the sliding surface and maintaining his eyes above the sight so as to see his face in the reflecting surface but not his eyes.

12. A method for practicing putting with a device as defined in claim 4, 5, 6, 7, 9 or 10, said method comprising the steps of:

a) positioning a golf ball in the putting line and positioning the sight above the ball and the putting line;

b) when a user is in a putting stance, placing the toe of the putter blade against the sliding surface of the first member;

c) positioning the toes of the feet of the user substantially parallel to the sliding surface of the first member and substantially equidistant from the center of the sight;

d) positioning the eyes of the user above the sight so as said user sees the ball through said sight and sight and sees his face in the planar reflecting surface but not his eyes; and e) according to a vertical pendulum movement, moving the putter head backwardly and then forwardly, to hit the golf ball while keeping the tip of the putter against the sliding surface and maintaining his eyes above the sight so as to see his face in the reflecting surface but not his eyes.

* * * * *